United States Patent [19]

Crane

[11] Patent Number: 4,534,398

[45] Date of Patent: Aug. 13, 1985

[54] SECURITY PAPER

[75] Inventor: Timothy T. Crane, Windsor, Mass.

[73] Assignee: Crane & Co., Dalton, Mass.

[21] Appl. No.: 605,578

[22] Filed: Apr. 30, 1984

[51] Int. Cl.[3] ..... D21D 3/00; D21H 5/10

[52] U.S. Cl. ..... 162/103; 162/123; 162/124; 162/125; 162/132; 162/140; 162/186

[58] Field of Search ..... 162/103, 105, 140, 108, 162/123, 132, 124, 183, 186, 125; 428/915, 916

[56] References Cited

U.S. PATENT DOCUMENTS

| | | | |
|---|---|---|---|
| 28,370 | 5/1860 | Howell | 162/140 |
| 167,223 | 8/1875 | Casilear | 162/140 |
| 3,880,706 | 4/1975 | Williams | 162/140 |
| 4,037,007 | 7/1977 | Wood | 162/140 |
| 4,437,935 | 3/1984 | Crane, Jr. | 162/140 |
| 4,462,867 | 7/1984 | Fuller | 162/140 |

*Primary Examiner*—Peter Chin

[57] ABSTRACT

This invention relates to a security paper document incorporating counterfeit deterrent, optical variable devices that display their optically active properties in reflectance when there are changes in the angle of incodent light with respect to the eye of the viewer. The devices are applied by means of a carrier paper and a base web format during the papermaking process. An embedment roll presses the device within the base web while the base web fibers are unconsolidated and pliable.

11 Claims, 8 Drawing Figures

SECURITY PAPER

BACKGROUND OF THE INVENTION

Banknote and security papers available in the marketplace today may incorporate a wide variety of materials to assist in verifying the authenticity of a document. The concept of incorporating optically variable devices OVD's as security elements in paper has received considerable attention in recent years.

As described in European Pat. No. 0059056, an optically variable dichroic device may be incorporated in the form of a continuous ribbon running through the material of the sheet. The elongated element, similar to the commonly used security thread, would be made visible at the surface at spaced locations during manufacture.

British Patent Specification No. 1552853, describes a dichroic filter material in the form of an elongated element formed into the substance of the sheet in a method similar to commonly used security threads. In this patent, the element is made visible through apertures or superposed windows in the base sheet. This process however requires the removal of overlaying fibers by some mechanical action imparted after the papermaking process.

In another British Patent Specification No. 1,365,876, a porous tape is described which can be formed within the substance of banknote paper. This tape consisting of a variety of specialized materials is incorporated within the banknote to yield unique properties. The advantage of the porous tape compared to the widely used, impervious, thin film, security thread is that it can be incorporated in far greater widths owing to its porous nature.

The deficiency of a continuous security strip, or ribbon having optically active properties lies in the narrow width to which it is confined. A constraint of approximately 2 mm maximum width is imposed by the sheet-forming process. Strips any wider than this cannot be reliably formed within the substance of the paper with a uniform fiber layer on either side. In addition, the location at which the elongated strips are exposed cannot be registered to specific locations during the papermaking process. Therefore, the entire security strip must be made optically active. Patterning within the optical strip cannot rely on being exposed in a registered format. Since it is important that significant portions of the strip be trapped within the fibers of the sheet to prevent removal, only small, narrow segments remain visible at the surface of the document. The limited refracting power of such small exposed areas severely limits its usefulness.

While a porous tape can be used to incorporate a wider elongated strip, there is no known method to date for exposing such a wide strip at the surface of the paper. With overlaying paper fibers at least partially obscurring the strip its ability to refract unscattered light having distinct color separation is limited.

The method of making windows or apertures disclosed in British Patent Specification No. 1,552,853 involves off-machine processing of finished paper. Since this process depends on removal of fibers, localized weakening of the paper can often occur.

An efficient method for incorporating security designs in paper is described within U.S. Pat. No. 4,437,935 to Fred Crane, which patent is incorporated herein for purposes of reference. This patent teaches the attachment of an optical element to a carrier web and application of the carrier web to a base web during the dewatering process within a Standard Fourdrenier paper making machine. However, to insure adequate dispersion of the base web fibers into the carrier web, the process is carried out at a controllable rate much slower than a conventional paper making process. It has since been determined that by modifying the paper making machine to include an embedment roll, the security paper can be manufactured in the same time required to make ordinary high quality banknote paper.

SUMMARY OF THE INVENTION

A security paper having optically variable devices is manufactured on a conventional Fourdrenier paper making machine having unique modifications. These modifications allow the devices, secured on the surface of a carrier paper, to be applied to the surface of a base web during the dewatering of the base web thereby facilitating deposition of the devices at prescribed locations and intervals. An embedment roll is employed to drive the device within the conformable fibers of the unconsolidated base web and to draw the base web fibers up into the carrier paper causing the two paper fibers to meld and adhere. The finished paper provides evidence that the security device was incorporated during the paper making process which is extremely difficult to accomplish without access to sophistiated paper making machinery and expertise.

DESCRIPTION OF THE PREFERRED EMBODIMENT

Figure 1:
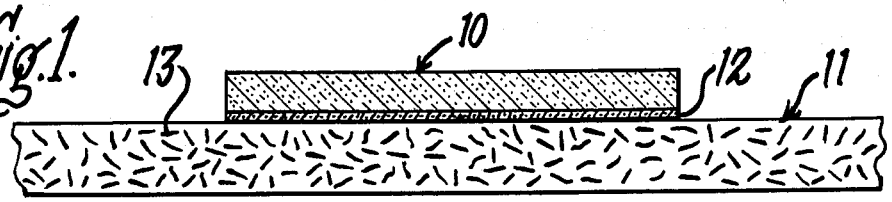
FIG. 1 is an enlarged cross sectional view of one security device attached to the carrier web.
Figure 2:
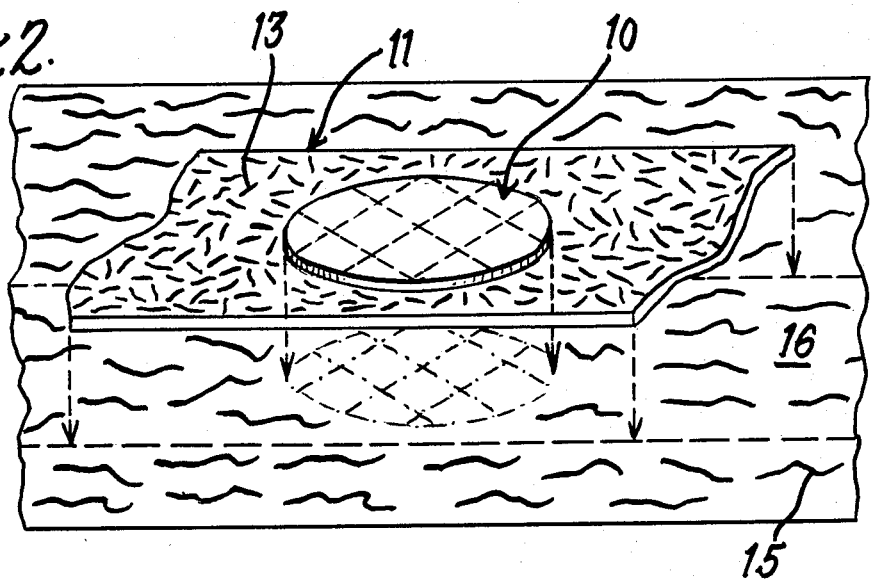
FIG. 2 is a plan view in isometric projection showing the carrier web with one security device prior to contact with the base paper web.
Figure 3:
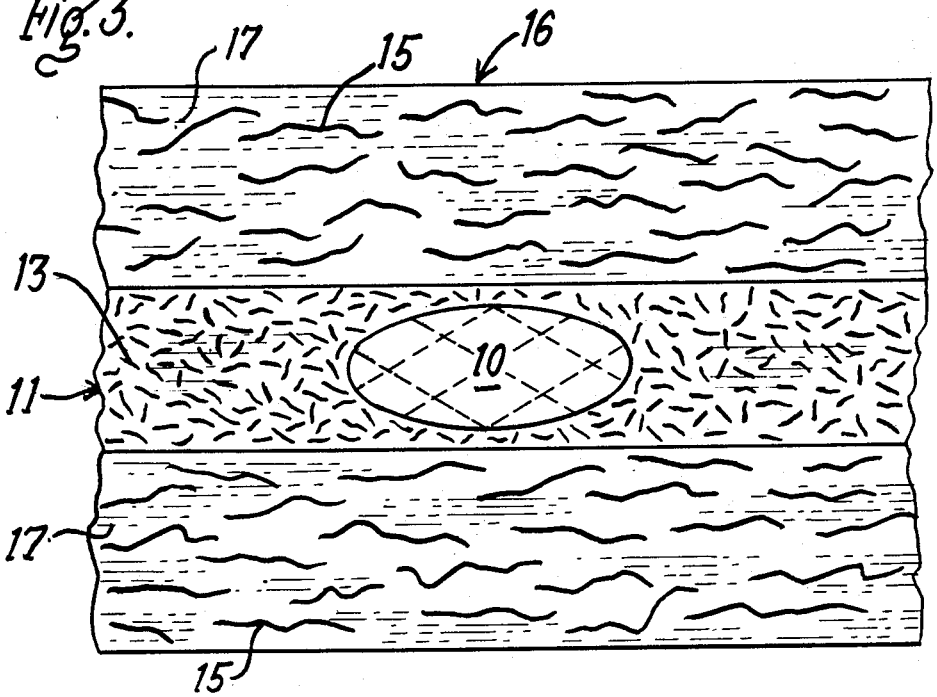
FIG. 3 is a plan view of the base paper web shown in FIG. 2 after contact with the carrier web, but before contact with the embedment roll.
Figure 4:
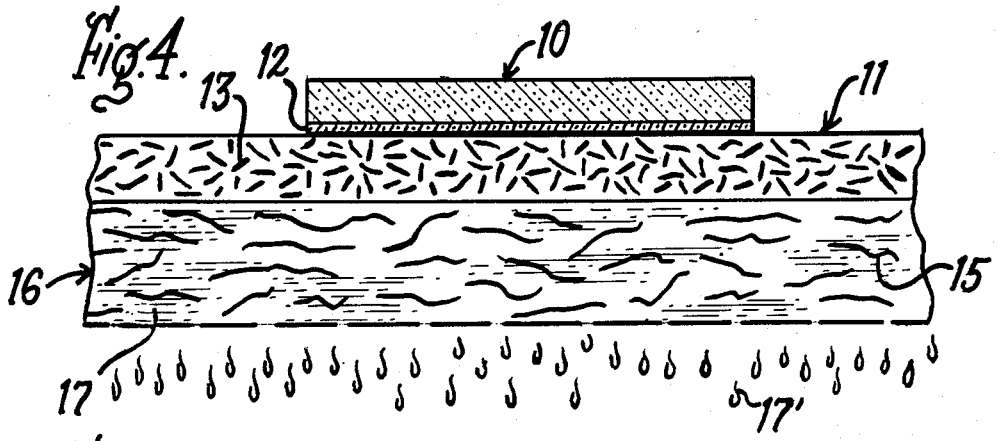
FIG. 4 is an enlarged cross sectional view of the base paper web with the carrier web and security device shown in FIG. 3.

In a manner similar to that described within the aforementioned patent to Crane, an optically variable device 10 is first attached to a dry carrier paper 11 consisting of a plurality of fibers 13 by means of an adhesive 12 which is applied by a labeling process as shown in FIG. 1. The optically variable device, hereafter OVD, consists of a plastic element which displays different optical characteristics with respect to the changes in the angle of incident light. One such OVD is produced by the successive layering of materials having differing refractive indices on a plastic or metalized substrate. The adhesive used in this process has both pressure sensing and thermal setting properties. One such adhesive being polyvinyl acetate which will tightly adhere to the subjacent fibers of the carrier paper throughout the process of applying the carrier paper to the base paper fibers 15 of a base paper web 16 as shown in FIG. 2. The carrier paper 11 is selected to have a dry fiber density of approximately 0.6 gms./cc. For purposes of this disclosure, the term "web" is used to describe the unconsolidated wet fibers of the base paper. The base paper web 16 hereafter "base web" is selected during the dewatering process to have a wet fiber consistency of from 4 to 6 percent as measured in accordance with the accepted Technical Association of Pulp and Paper Industries Standards during the web consolidation process. This base web consistency insures that the base web fibers are sufficiently mobile to flow under controlled conditions into the voids of the more porous carrier paper. The carrier paper composition comprises cellulose fibers such as 45% bleached hemp pulp and 19% bleached kraft pulp mixed with non-cellulose fibers such as 30% polyvanilidine chloride. A binder composition consisting of 5.0% polyvinyl alcohol, 0.5% caboxymethyl cellulose and 0.5% polyamide epichlorohydrin is mixed with the fibers to provide a uniform adherent composition upon drying. For purposes of this disclosure the term "base web" is used to describe the base paper fibers when used within the paper making machine and when saturated with the water supplied from the head box which contains the original fibers used to provide the base web in a conventional paper making process such as described within U.S. Pat. Nos. 1,163,251; 2,009,185 and 4,045,281 which patents are incorporated herein for purposes of reference. The OVD's are applied to the carrier paper when it is dry and has a consistency similar to that of tissue paper. The carrier paper containing the OVD's is then applied to the base web during the paper making process and is wetted by the same water used to form the base paper. The base paper composition comprises a mixture of cotton and linen fibers adjusted to the aforementioned consistency. Upon contacting the base web, the carrier paper becomes wet without dispersing or losing the inter-fiber bonds which existed in the dry state. This is shown in FIG. 3 wherein the carrier paper 13 first contacts and becomes wet by the water composition designated by lines 17 which wets both the carrier paper 11 as well as the base web 16. The OVD 10 remains fixed at the instant of contact between the carrier paper and the base web. This is due to the firm adherence of the OVD to its subjacent fibers provided by the adhesive. The initial localization of the carrier fibers 13 and base fibers 15 and between the carrier paper 11 and base web 16 is shown in FIG. 4. The point of deposition of the carrier paper is selected during the base web forming process when the base fibers just begin to consolidate and form the web. It can be seen that the water 17 immediately wets the carrier fibers 13 while the base web 16 continues dewatering as indicated by the water drops, 17' passing through the Fourdrenier wire screen 14.

Figure 5:
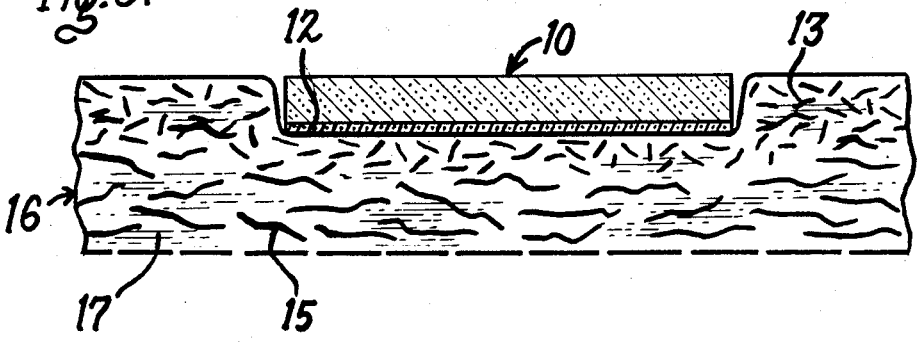
FIG. 5 is an enlarged cross sectional view of the base paper web and carrier web after contact with the embedment roll.
Figure 7:
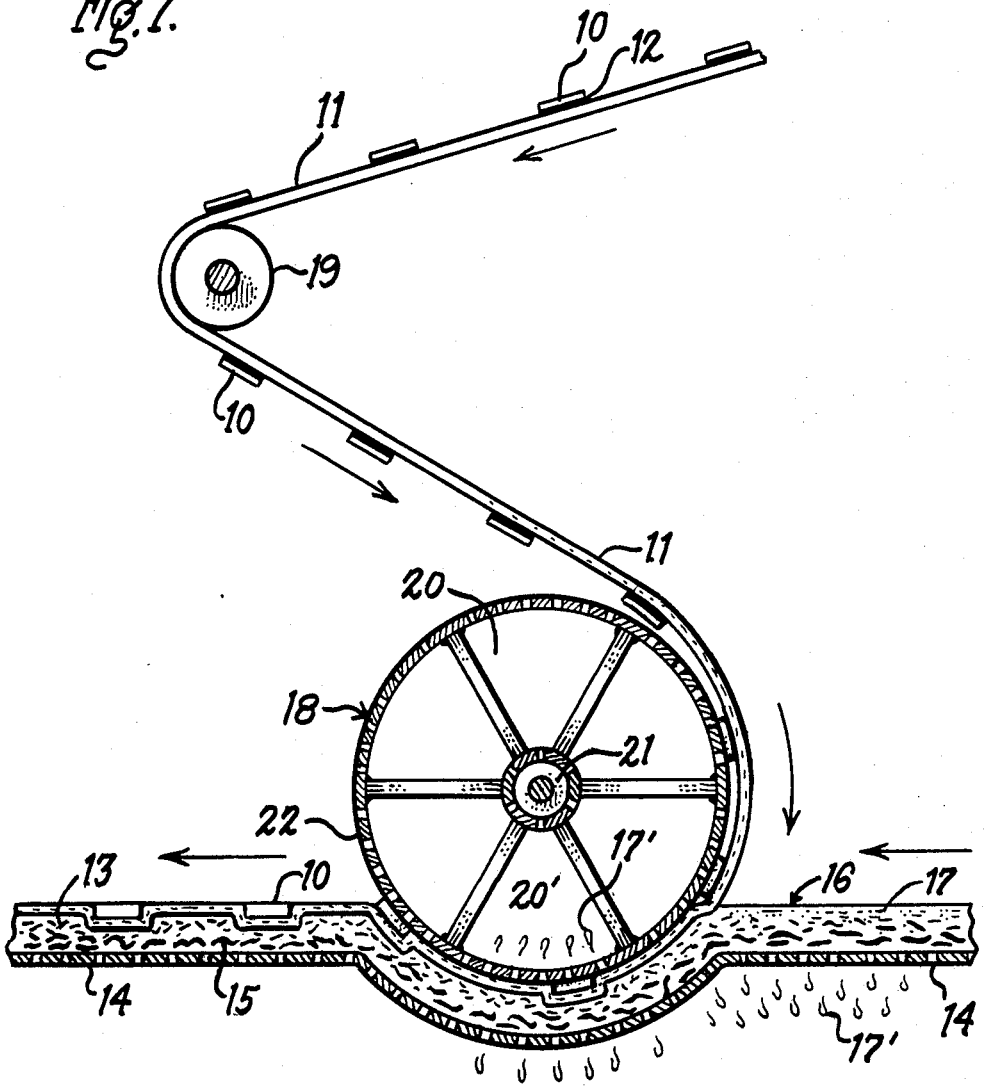
FIG. 7 is a side view of the modified paper making machine used to introduce the carrier web containing the security elements into the base web.

FIG. 5 shows the OVD after the carrier paper has passed between an embedment roll 18 having the configuration depicted in FIG. 7. The dry carrier paper with the OVD's facing upwards 11 is conveyed from a source roll (not shown) over a carrying roll 19 which inverts the OVD's to a downwards facing direction in contact with a coarse mesh screen 22. A series of chambers 20 radially interconnect with a central core 21. At the bottommost point of rotation, the roll contacts the carrier paper 11 and forces the OVD's 10 down into the base web 16 while at the same time a vacuum exerted through lowermost chamber 20' draws water up from the base web 16. This is an important feature of the invention since some fibers 15 from the base web 16 are drawn up into the carrier paper 11 to intermix with the carrier fibers 13. The intermingling of the carrier fibers and base web fibers 15, 13 is shown in FIG. 5. The surface of the OVD's become level with the surface of the carrier paper 11 as the carrier paper 11 is depressed downward within the base web 16. This insures that the OVD's will be visible at the surface of the finished composite paper which consists of both the carrier paper and base web fibers and that the OVD's cannot be removed from the composite paper without destroying either the OVD's or the composite paper.

Figure 6:
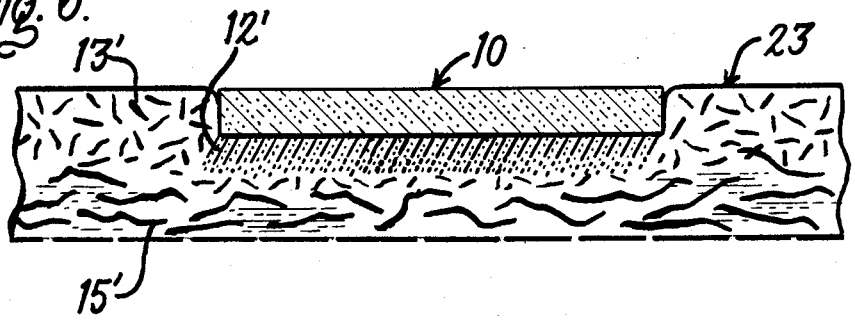
FIG. 6 is an enlarged cross sectional view of the finished paper containing the security device incorporated therein.

FIG. 6 shows the composite paper 23 which is formed in the conventional pressing and drying operation of the paper making process. The carrier fibers and base fibers are compacted together to form the composite paper and are fused together by the melting of the heat meltable polyvanilidine chloride fibers which form part of the carrier paper. The cellulosic carrier and base fibers which retain their integrity after the pressing and drying process are now designated as 13' and 15' within the composite paper. The enlarged sectional view shows a clear separation between these fibers. However in actual scale of thickness, in the order of 2 to 3 thousandths of an inch, the separation between these fibers is difficult to perceive without some means of optical magnification. The adhesive material 12 also melts during the pressing and drying operation and is forced down within the composite paper as indicated at 12'. The strong bond formed by the heat meltable fibers and the diffusion of the adhesive down through the composite paper provides excellent adherence between the OVD and the composite paper when durability tests consisting of flexing, crumbling and folding operations are performed.

Figure 8:
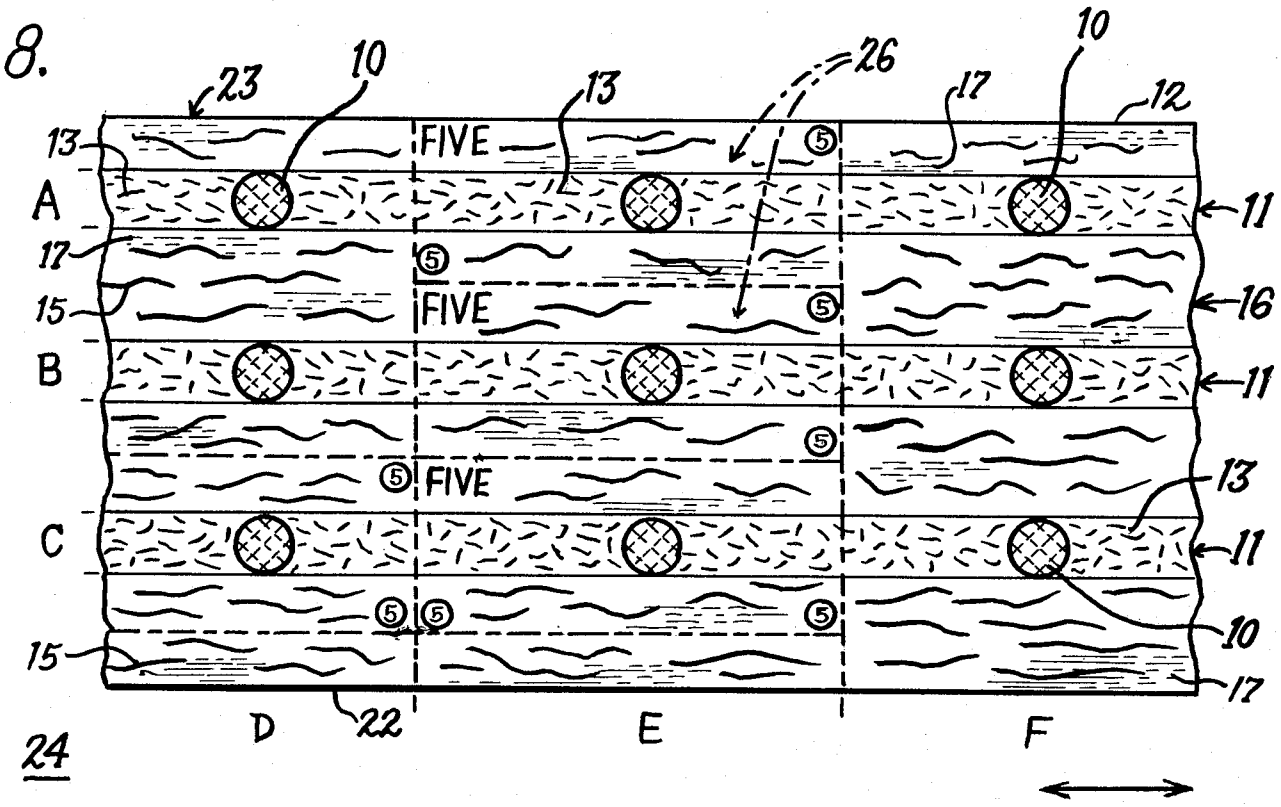
FIG. 8 is a plan view of the papermachine with several carrier webs insertion into the base web, localized as to position in the machine direction and crossmachine direction.

A plurality of OVD's can be applied to a large single base paper by the arrangement shown in FIG. 8 where several strips of carrier paper 11 are arranged across from the front 22 to the back 23 of the paper machine in a series of rows such as A-C, with the OVD's on each row arranged in a series of columns such as D-F along the paper machine generally shown at 24 containing a common base web 16. The carrier fibers 13 are shown after embedment within the base paper fibers 15. This arrangement allows a plurality of banknotes and currency bills to be printed from a common strip of composite paper when the paper making process is completed. This is shown by the banknotes 26 indicated in phantom for the OVD's 10 along column E, for example.

It is thus seen that optically variable devices such as diffraction gratings can be fixedly incorporated within paper for use in currency and other valuable papers for security purposes. The arrangement of the devices on a carrier paper for embedment within base fibers provides the strongest attachment between the devices and the base paper ever heretofore attainable by any known techniques.

I claim:

1. A method of forming a security paper on a paper making machine comprising the steps of:

attaching a water impervious security device to a surface of a non-water dispersible porous carrier paper;

passing said carrier paper and security device between the outer surface of an embedment roll and wet base paper fibers to wet and press said carry paper and security device within said wet base paper fibers while drawing some of said wet base fibers and some of said water up to within said carrier paper to form a composite paper; and pressing and heating said composite paper to form a composite paper having said security device coextensive with a surface of said composite paper.

2. The method of claim 1 wherein said security device is attached to said carrier paper by means of a water insoluble heat sensitive adhesive.

3. The method of claim 1 wherein said carrier paper is less dense than said wet base web to allow said base paper fibers to pass through said carrier paper.

4. The method of claim 1 wherein said carrier paper and said base paper fibers include thermoplastic fibers.

5. The method of claim 2 wherein said adhesive becomes melted during said heating and adheres said security device to said composite paper.

6. The method of claim 1 wherein said wet drawing of said base paper fibers comprises a vacuum within said embedment roll.

7. The method of claim 1 wherein said heat sensitive adhesive comprises a thermoplastic.

8. The method of claim 2 wherein the step of attaching said security device to said carrier paper comprises:

providing said carrier paper from a continuous roll;

applying said adhesive to a surface of said security device; and pressing said security device onto the surface of said carrier paper.

9. The method of claim 1 wherein said security device comprises an optically variable device.

10. The method of claim 1 wherein said security device comprises a plastic, paper or glass substrate.

11. The method of claim 4 wherein said thermoplastic fibers comprise polyvanilidine chloride.

* * * * *